US006595615B2

(12) United States Patent
Ylitalo

(10) Patent No.: US 6,595,615 B2
(45) Date of Patent: Jul. 22, 2003

(54) METHOD AND APPARATUS FOR SELECTION OF INKJET PRINTING PARAMETERS

(75) Inventor: Caroline M. Ylitalo, Stillwater, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/001,144

(22) Filed: Nov. 15, 2001

(65) Prior Publication Data

US 2002/0085056 A1 Jul. 4, 2002

Related U.S. Application Data

(60) Provisional application No. 60/259,458, filed on Jan. 2, 2001.

(51) Int. Cl.[7] ..... B41J 29/393
(52) U.S. Cl. ..... 347/19
(58) Field of Search ..... 347/19, 100, 101–102, 347/14, 78, 7, 22, 23, 8, 6, 9, 5; 101/488

(56) References Cited

U.S. PATENT DOCUMENTS

| | | | | |
|---|---|---|---|---|
| 4,469,026 A | | 9/1984 | Irwin | |
| 4,774,523 A | | 9/1988 | Beaufort et al. | |
| 5,275,646 A | | 1/1994 | Marshall et al. | |
| 5,349,905 A | | 9/1994 | Taylor et al. | |
| 5,502,464 A | | 3/1996 | Takahashi et al. | |
| 5,508,826 A | | 4/1996 | Lloyd et al. | |
| 5,511,477 A | | 4/1996 | Adler et al. | |
| 5,530,466 A | | 6/1996 | Fujioka et al. | |
| 5,614,933 A | * | 3/1997 | Hindman et al. | 347/103 |
| 5,721,086 A | | 2/1998 | Emslander et al. | |
| 5,757,407 A | | 5/1998 | Rezanka | |
| 5,771,054 A | | 6/1998 | Dudek et al. | |
| 5,847,743 A | | 12/1998 | Look | |
| 5,875,287 A | | 2/1999 | Li et al. | |
| 5,975,677 A | * | 11/1999 | Marler et al. | 347/40 |
| 5,981,113 A | | 11/1999 | Christian | |
| 6,517,184 B1 | * | 2/2000 | Bruch et al. | 347/23 |
| 6,039,426 A | | 3/2000 | Dobbs | |
| 6,082,911 A | | 7/2000 | Murakami | |
| 6,092,890 A | | 7/2000 | Wen et al. | |
| 6,114,022 A | | 9/2000 | Warner et al. | |
| 6,145,979 A | | 11/2000 | Caiger et al. | |
| 6,248,404 B1 | | 6/2001 | Greene-Mathis | |

FOREIGN PATENT DOCUMENTS

| | | |
|---|---|---|
| EP | 0 134 591 | 3/1985 |
| EP | 0 658 607 | 9/1998 |

(List continued on next page.)

OTHER PUBLICATIONS

Practical Considerations for Using UV Reactive Inks in Piezo DOD Printheads, Richar J. Baker, Spectra Inc., Hanover, New Hampshire, USA, 1999, pp. 111–115.

(List continued on next page.)

*Primary Examiner*—Raquel Yvette Gordon
*Assistant Examiner*—Charles W. Stewart
(74) *Attorney, Agent, or Firm*—James D. Christoff

(57) ABSTRACT

Methods and apparatus for inkjet printing include automated techniques for selecting and/or adjusting printing parameters. The techniques include methods for altering test pattern images received on a substrate for assessing certain characteristics, such as adhesion of a particular ink to a particular substrate. A computer selects certain printing parameters based on an assessment of the altered test pattern images.

43 Claims, 2 Drawing Sheets

FOREIGN PATENT DOCUMENTS

| | | |
|---|---|---|
| EP | 0 875 382 | 11/1998 |
| EP | 0 889 639 | 1/1999 |
| EP | 0 978 390 | 2/2000 |
| EP | 1 034 936 | 9/2000 |
| EP | 1 046 511 | 10/2000 |
| EP | 1 108 553 | 6/2001 |
| GB | 2 142 579 | 1/1985 |
| GB | 2 233 928 | 1/1991 |
| GB | 2 322 597 | 9/1998 |
| GB | 2 338 212 | 12/1999 |
| JP | 6-200204 | of 0000 |
| JP | 62109645 | 5/1987 |
| JP | HEI 1-133746 | 5/1989 |
| JP | 02092642 | 4/1990 |
| JP | 8218016 | 8/1996 |
| JP | 8218017 | 8/1996 |
| JP | 8218018 | 8/1996 |
| JP | 10-207978 | 8/1998 |
| JP | 11-070645 | 3/1999 |
| JP | 2000211219 | 2/2000 |
| WO | WO 97/04964 | 2/1997 |
| WO | WO 97/27053 | 7/1997 |
| WO | WO 97/31071 | 8/1997 |
| WO | WO 99/08875 | 2/1999 |
| WO | WO 99/29788 | 6/1999 |
| WO | WO 00/73083 | 12/2000 |
| WO | WO 01/17780 | 3/2001 |

OTHER PUBLICATIONS

Noguchi, Hiromichi, Final Program and Proceedings of IS&T's NIP14: International Conference on Digital Printing Technologies, IS&T—The Society for Imaging Science and Technology, Oct. 1998, UV Curable, Aqueous Ink Jet Ink: Material Design and Performance for Digital Printing, pp. 107–110.

56281US003, U.S. Ser. No. 10/000,282, Filed Nov. 15, 2001.

56280US003, U.S. Ser. No. 10/001,101, Filed Nov. 15, 2001.

55435US002, U.S. Ser. No. 09/562,018, Filed May 1, 2000.

* cited by examiner

METHOD AND APPARATUS FOR SELECTION OF INKJET PRINTING PARAMETERS

This application calims benefit of Provisional application Ser. No. 60/259,458 filed Jan. 2, 2001.

BACKGROUND OF THE INVENTION

1. Field of the Invention

This invention relates to inkjet printing apparatus and methods for inkjet printing. More particularly, the present invention is directed to methods and apparatus for selecting the process parameters used in inkjet printing and for carrying out the selected process.

2. Description of the Related Art

Inkjet printing has increased in popularity in recent years due to its relatively high speed and excellent image resolution. Moreover, inkjet printing apparatus used in conjunction with a computer provides great flexibility in design and layout of the final image. The increased popularity of inkjet printing and the efficiencies in use have made inkjet printing an affordable alternative to previously known methods of printing.

In general, there are three types of inkjet printers in widespread use: the flat bed printer, the roll-to-roll printer and the drum printer. In the flat bed printer, the medium or substrate to receive the printed image rests on a horizontally extending flat table or bed. An inkjet print head is mounted on a movable carriage or other type of mechanism that enables the print head to be moved along two mutually perpendicular paths across the bed. The print head is connected to a computer that is programmed to energize certain nozzles of the print head as the print head traverses across the substrate, optionally using inks of different colors. The ink on the substrate is then cured as needed to provide the desired final image.

In roll-to-roll inkjet printers, the substrate to receive the printed image is commonly provided in the form of an elongated web or sheet and advances from a supply roll to a take-up roll. At a location between the supply roll and the take-up roll, a print head is mounted on a carriage that is movable to shift the print head across the substrate in a direction perpendicular to the direction of advancement of the substrate. Known roll-to-roll inkjet printers include vertical printers, wherein the substrate moves in an upwardly direction past the print head, as well as horizontal printers, wherein the substrate moves in a horizontal direction past the print head.

Drum inkjet printers typically include a cylindrical drum that is mounted for rotational movement about a horizontal axis. The substrate is placed over the periphery of the drum and an inkjet print head is operable to direct dots or drops of ink toward the substrate on the drum. In some instances, the print head is stationary and extends along substantially the entire length of the drum in a horizontal direction. In other instances, the length of the print head is somewhat shorter than the length of the drum and is mounted on a carriage for movement in a horizontal direction across the substrate.

Inks that are commonly used in inkjet printers include water-based inks, solvent-based inks and radiation-curable inks. Water-based inks are often used with porous substrates or substrates that have a special receptor coating to absorb the water. In order to cure the ink after it has been applied to the substrate by the print head, the printer often includes a heat source such as an internally heated bed or infrared heater in order to evaporate water in the ink.

Solvent-based inks used in inkjet printers are suitable for printing on non-porous films. Often, inkjet printers using solvent-based inks have a curing device that also includes a heater. The heater accelerates the rate of evaporation of the solvent and hence the curing of the ink after it is applied to the substrate. Such inkjet printers also often include an environmental system for collecting the solvent gases so that health risks to the operator are reduced.

Inkjet printers using radiation-curable inks have increased in popularity in recent years for printing on non-porous substrates. The use of radiation curing, such as ultraviolet ("UV") radiation, enables the ink to cure relatively quickly without the need to dry large quantities of water or solvent. Commonly, the curing device of such printers comprises a radiation source such as a lamp that is spaced from the substrate a distance sufficient to provide prompt curing of the applied ink.

In modern inkjet printers, the speed of delivery of the printed image is considered to be of utmost importance. Still, care should be taken when selecting the combination of ink and the substrate, taking into account the type of printer to be used in printing the image. However, inkjet printers that are capable of printing on relatively large substrates are considered expensive. It is desirable to use the same printer to impart images to a wide variety of substrates using a wide variety of ink compositions if at all possible.

For example, the surface chemistry of the selected substrate can substantially affect the receptiveness of the substrate to the selected ink. This variation in receptiveness of the substrate to ink can vary not only from material to material, but also from lot to lot of the same class of materials. In addition, the behavior of ink on the substrate may be profoundly impacted by the selection of printing parameters of the inkjet printer that is used.

The printer operator is often provided with little guidance as to the selection of process parameters that will provide the best image quality for any combination of ink and substrate. Today, many operators use a manual trial-and-error methodology in an attempt to optimize the parameters of the printing process. For example, the operator may print a number of images and vary the curing time or temperature of the curing device. Once the images have cured, the operator visually reviews each image for image quality in order to help select an optimal temperature and/or curing time.

As can be appreciated, the manual methodology for selecting printing parameters as described above is somewhat time-consuming and tedious. This selection process is also subject to human error. In addition, the criteria for selection of the optimal image is somewhat subjective and may result in a substantial difference of image quality from one operator to another.

U.S. Pat. Nos. 5,508,826 and 6,039,426 describe automated methods for selection of printing parameters. In these patents, test pattern images are applied to a substrate and an optical detector examines the printed images. The detector is connected to a computer that, in certain instances, selects a printing parameter based in part on certain characteristics sensed by the optical detector.

However, there is a continuing need in the art to improve inkjet printers so that the final printed image is of satisfactory quality on a consistent basis. For example, the automated image quality detection techniques as described above do not necessarily assess all of the characteristics of the final printed image that may be needed to accurately determine whether or not the printed image will remain in a satisfactory condition over an extended period of time during its intended use. The longevity of the image quality is particularly important in instances where the image is to be displayed in exterior conditions, such as for use on an outdoor sign or banner used in advertising.

SUMMARY OF THE INVENTION

The present invention is directed to inkjet printing apparatus and methods for inkjet printing that include automated techniques for selecting and/or adjusting printing parameters. The resulting printed image is highly durable and exhibits a satisfactory image quality for extended periods of time. The present invention includes automated methods for altering test pattern images received on a substrate for assessing certain characteristics, such as adhesion of a particular ink to a certain substrate. A computer is used to determine which of the test pattern images exhibits optimal desired characteristics and then transmits signals that are used to adjust one or more of the parameters used in printing the final desired image.

In a particularly preferred embodiment of the invention, the printing apparatus includes a device for abrading at least a portion of the test pattern images. The device may include a stylus, a section of abrasive material or other structure that bears against the printed test pattern images with a certain pressure. An optical detector such as a spectrophotometer then scans the portion of the test pattern images that have been in contact with the abrading device, in order to ascertain which test pattern images have not been unduly damaged by the abrading device. The printing parameters used for such image or images are then used as a basis for selecting parameters for use in printing the final product.

In more detail, the present invention is directed in one aspect to inkjet printing apparatus that comprises a support for receiving a substrate and an inkjet print head for directing ink to the substrate received on the support in order to provide an image. A controller is connected to the print head for activating the print head to print at least two test pattern images on the substrate, and the controller causes at least two test pattern images to be printed using different printing parameters. The apparatus also includes a device for altering at least one of the test pattern images on the substrate, and a detector for detecting one or more characteristics of the test pattern images. The detector is connected to the controller and the controller is selectively operable to vary at least one of the printing parameters in order to achieve a desired final product.

Another embodiment of the present invention is also directed to an inkjet printing apparatus. In this embodiment, the apparatus includes a support for receiving a substrate and a print head for directing ink to a substrate received on the support in order to provide an image. The apparatus includes a device for contacting at least a portion of the image on the substrate, and a detector for detecting one or more characteristics of the contacted image.

An additional embodiment of the invention is directed toward an inkjet printing method. The method includes the act of selecting an ink, a substrate and a printer for printing the ink on the substrate. The method also includes the act of inkjet printing the ink in a plurality of test pattern images on the substrate with the printer, wherein at least one of the test pattern images is printed using one or more different printing parameters than the printing parameters used to print another test pattern image. The method also includes the acts of altering at least one of the test pattern images, and detecting one or more characteristics of at least one altered test pattern image. The method further includes the acts of correlating the detected characteristics of at least one altered test pattern image with one or more printing parameters, and selecting one or more certain printing parameters for the selected ink and the selected substrate based on the correlation. The method also includes the act of printing a final product with the printer using the selected printing parameters.

These and other aspects of the invention are described in more detail in the paragraphs that follow and are illustrated in the accompanying drawings.

DETAILED DESCRIPTION OF THE PREFERRED EMBODIMENTS

The following examples describe one type of printing apparatus that utilizes UV curable inks and related printing methods according to the invention. The accompanying drawings are schematic illustrations selected to highlight certain aspects of that embodiment. In practice, the concepts described below may be adapted for use with a variety of inkjet printers, including many commercially available inkjet printers. Examples of suitable rotating drum type inkjet printers include "PressJet" brand printers from Scitex (Rishon Le Zion, Israel) and "DryJet" Advanced Digital Color Proofing System from Dantex Graphics Ltd. (West Yorkshire, UK). Examples of flat bed type inkjet printers include "PressVu" brand printers from VUTEk, Inc. (Meredith, N.H.) and "SIAS" brand printers from Siasprint Group (Novara, Italy). Examples of roll-to-roll inkjet printers include "Arizona" brand printers from Raster Graphics, Inc. of Gretag Imaging Group (San Jose, Calif.) and ""UltraVu" brand printers from VUTEk, Inc. Additionally, the invention may be used for inks other than UV curable inks, such as water-based inks and solvent-based inks.

Figure 1:
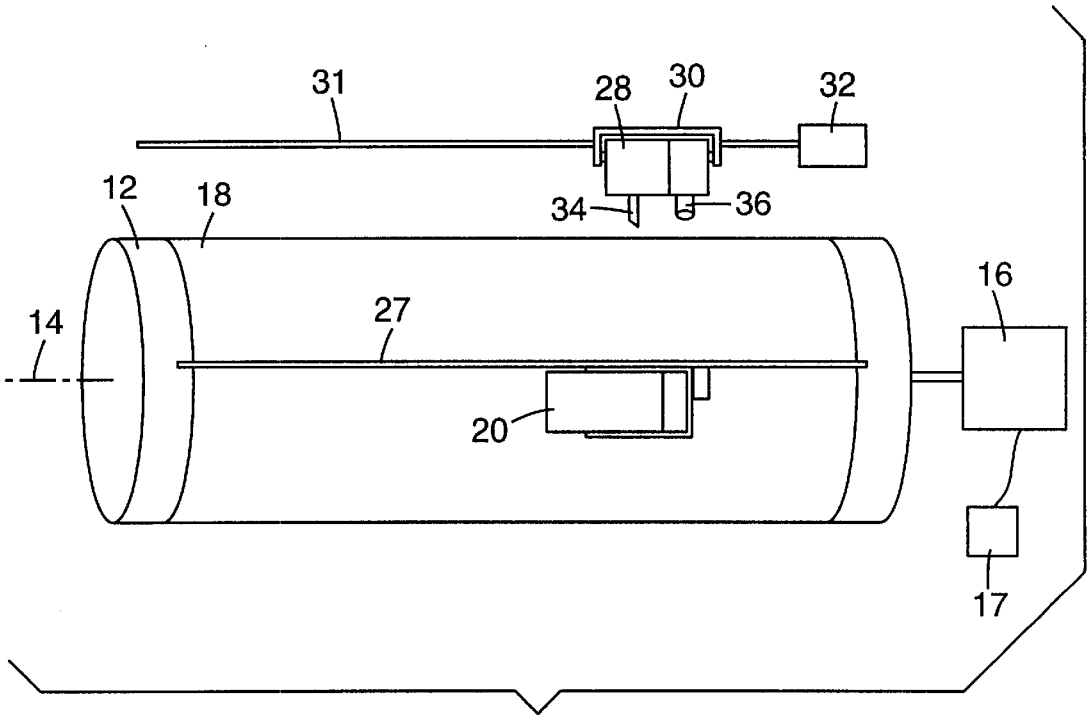
FIG. 1 is a schematic, side elevational view showing a portion of an inkjet printing apparatus according to one embodiment of the invention, wherein the apparatus in this instance is a rotatable drum inkjet printer.
Figure 2:
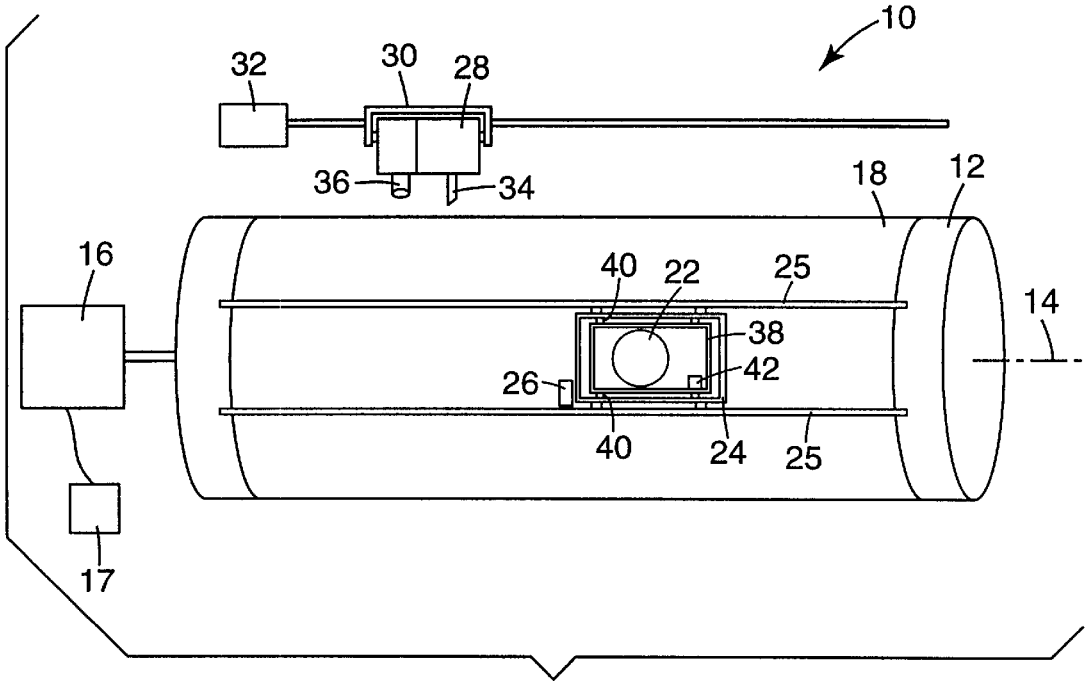
FIG. 2 is a view somewhat similar to FIG. 1 except showing the apparatus from an opposite side.
Figure 3:
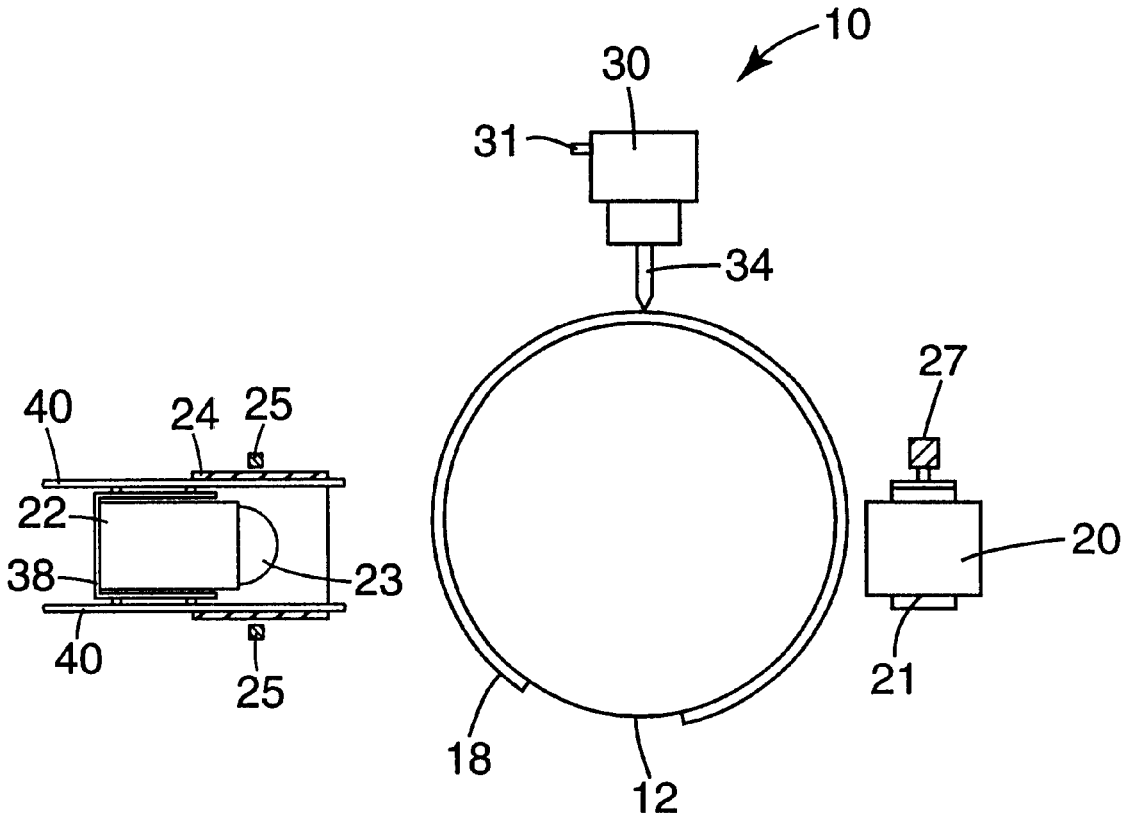
FIG. 3 is a schematic end elevational view of the inkjet printing apparatus depicted in FIGS. 1 and 2.

FIGS. 1–3 illustrate components of an inkjet printing apparatus 10 that have been constructed and arranged according to one embodiment of the present invention. The apparatus 10 includes a cylindrical support or drum 12 for supporting a substrate to be printed. The drum 12 includes a central reference axis that is designated by the numeral 14 in FIGS. 1 and 2.

The apparatus 10 also includes a motor 16 for rotatably moving the drum 12 about its central axis 14. The motor 16 may be connected to the drum 12 by any suitable means, including a chain drive system, a belt drive system, a gear mechanism or the like. The motor 16 is connected to a controller 17 for starting or stopping rotational movement of the drum 12 when desired.

A substrate 18 to be printed is received on the external surface of the drum 12. The substrate 18 may be made of any suitable material that is compatible with the selected inks and that exhibits satisfactory characteristics once placed in use in a desired location. Examples of suitable substrates 18 include both porous and nonporous materials such as glass, wood, metal, paper, woven and non-woven materials and polymeric films. Nonlimiting examples of such films include single and multi-layer constructions of acrylic-containing films, poly(vinyl chloride)-containing films, (e.g., vinyl, plasticized vinyl, reinforced vinyl, vinyl/acrylic blends), urethane-containing films, melamine-containing films, polyvinyl butyral-containing films, and multi-layered films having an image reception layer comprising an acid- or acid/acrylate modified ethylene vinyl acetate resin, as disclosed in U.S. Pat. No. 5,721,086 (Emslander et al.) or having an image reception layer comprising a polymer comprising at least two monoethylenically unsaturated monomeric units, wherein one monomeric unit comprises a substituted alkene where each branch comprises from 0 to about 8 carbon atoms and wherein one other monomeric unit comprises a (meth)acrylic acid ester of a nontertiary alkyl alcohol in which the alkyl group contains from 1 to about 12 carbon atoms and can include heteroatoms in the alkyl chain and in which the alcohol can be linear, branched, or cyclic in nature.

Optionally, one side of the film opposite the printed side includes a field of pressure sensitive adhesive. Usually, the field of adhesive on one major surface is protected by a release liner. Moreover, the films can be clear, translucent, or opaque. The films can be colorless, a solid color or a pattern of colors. The films can be transmissive, reflective, or retroreflective. Commercially available films known to those skilled in the art include the multitude of films available from 3M Company under the trade designations PANAFLEX, NOMAD, SCOTCHCAL, SCOTCHLITE, CONTROLTAC, and CONTROLTAC-PLUS.

The printing apparatus 10 also includes a print head 20 for directing UV radiation curable ink toward the substrate 18. In this embodiment, the print head 20 comprises a bank of print heads that extends across a portion of the drum 12. The print head 20 is connected to a source of UV radiation curable ink (not shown). In addition, the print head 20 is electrically coupled to the controller 17 for selective activation when desired. Examples of UV curable inkjet inks that can be used in the apparatus 10 include compositions such as those described in U.S. Pat. Nos. 5,275,646 and 5,981,113 and PCT application nos. WO 97/31071 and WO 99/29788.

As one option, the length of the print head 20 may be substantially equivalent to the axial length of the drum 12. As another option, and as shown in the drawings, the length of the print head 20 may be shorter than the length of the drum 12. In the latter option, the print head 20 is mounted on a carriage 21 for movement along a rail 27 in a direction parallel to the longitudinal axis of the drum. The carriage 21 is connected to a drive means (such as a stepping motor 19 that is coupled to a rack and pinion assembly) and the drive means is connected to the controller 17 for selective movement. Movement of the print head 20 enables the substrate 18 to be printed across its entire width as may be desired.

Optionally, the print head 20 is operable to simultaneously print ink of different colors. To this end, the print head 20 may include a first set of nozzles that are in fluid communication with a first source of ink of a certain color and a second set of nozzles that are in communication with a second source of ink of a different color. Preferably, the print head 20 has at least four sets of nozzles that are in communication with at least four corresponding ink sources. As a result, the print head 20 is operable to simultaneously print at least four inks of different colors so that a wide color spectrum in the final printed image can be achieved.

Optionally, the print head 20 includes an additional set of nozzles that is in communication with a source of clear ink or other material that lacks color. The clear ink can be printed on the substrate 18 before any colored ink is applied, or can be printed over the entire image. Printing clear ink over the entire image can be used to improve performance of the finished product, such as by improving durability, gloss control, resistance to graffiti and the like.

The apparatus 10 also includes a curing device 22 (FIGS. 2 and 3) for directing actinic radiation toward ink that is received on the substrate 18. The curing device may include one or more sources of radiation, each of which is operable to emit light in the ultraviolet and/or visible spectrum. Suitable sources of UV radiation include mercury lamps, xenon lamps, carbon arc lamps, tungsten filament lamps, lasers and the like. Optionally, the sources of radiation are lamps of a type commonly known as "instant-on, instant-off" so that the time that the radiation reaches the substrate 18 can be precisely controlled. In the embodiment of the invention that is shown in the drawings, the curing device 22 includes a UV lamp 23 (FIG. 3) that is masked to direct radiation when activated only to a certain portion of the substrate 18.

The curing device 22 is electrically connected to the controller 17 for activation and deactivation of the lamp 23. Additionally, the curing device 22 is mounted on a carriage 24 for movement along two parallel rails 25 which provide a path that is preferably parallel to the central reference axis 14. The carriage 24 is linked to a drive 26 for movement in either direction along the path. The drive 26 is connected to the controller 17 for selective, timed movement of the carriage 24 and the curing device 22 in either direction along the path.

The apparatus 10 also includes a device 28 for altering test pattern images that are printed on the substrate 18. The device 28 is mounted on a carriage 30 that is movable along a rail 31 that extends parallel to the central reference axis 14. The carriage 30 is connected to a drive 32 that, in turn, is connected to the controller 17. The drive 32 is operable to move the carriage 30 with the alteration device 28 along the rail 31 after the test pattern images have been printed.

In this embodiment, the device 28 includes a stylus 34 for altering the test pattern images. The device 28 also includes a mechanism (not shown) for shifting the stylus 34 toward the substrate 18 on the drum 12 in order to contact the substrate 18 with a certain, pre-selected pressure. As the stylus 34 bears against the test pattern image, the drive 32 moves the device 28 along the aforementioned path. Preferably, the path extends along a series of previously printed test pattern images that are arranged in a row across the substrate 18 in directions parallel to the reference axis 14.

Preferably, the mechanism is operable to shift the stylus 34 either toward or away from the drum 12 when desired. The mechanism is electrically connected to the controller 17. Once the stylus 34 is moved across the test pattern images, the controller 17 activates the mechanism to shift the stylus 34 away from the drum 12 and out of contact with the substrate 18.

The apparatus 10 also includes a detector 36 for detecting one or more characteristics of the altered test pattern images. Preferably, the detector 36 is mounted on the carriage 30 in a location directly behind the device 28 (when considered relative to the direction of travel of the device 28 during an abrasion test). As the device 28 advances in transverse fashion across the substrate 18, the detector 36 senses characteristic(s) of the test pattern images along locations of the images where the stylus 34 has previously traveled.

Optionally, the detector 36 is operable to detect the specular reflection of the test pattern images. An example of a suitable detector 36 is a spectrophotometer. The spectrophotometer detects, in essence, the presence or absence of ink on the substrate 18. As a result, if the ink or a portion of the ink has been previously removed by the stylus 34, the detector 36 will transmit a different signal to the controller 17 than would be transmitted if all of the ink remained on the substrate 18.

During printing of the test pattern images, at least one of the images is printed using one or more different printing parameters than the printing parameters used to print another test pattern image. For example, the intensity of UV radiation from the curing device 22 may vary for each of the test pattern images. The intensity of the UV radiation emitted by the curing device 22 may be changed, for example, by altering the voltage to the curing lamp 23, or by moving the curing device 22 either toward or away from the drum 12.

In the embodiment shown in the drawings, the intensity of the UV radiation is varied by a mechanism that moves the curing device 22 either toward or away from the drum 12. In particular, the curing device 22 is mounted on a second carriage 38. The carriage 38 is movably coupled to four horizontal guide rails 40 and is connected to a drive 42 (FIG. 2) that is electrically connected to the controller 17. Activation of the drive 42 moves the second carriage 38 along the rails 40 in a direction either toward or away from the central reference axis 14.

In use, the substrate 18 is mounted on the drum 12. The controller 17 then activates the motor 16 to turn the drum 12 to a suitable rotative position such that a selected section of the substrate 18 for receiving the test pattern images is located directly adjacent the path of travel of the print head 20. For example, the test pattern images may be applied along one edge portion of the substrate 18. In that instance, the controller 17 activates the motor 16 so that the edge section of the substrate 18 is directly beneath the path of the print head 20.

Next, the controller 17 activates the print head 20 to print a series of test pattern images. The test pattern images may be discreet images or may be combined to form one single image. In this example, all of the test pattern images are printed by the print head 20 using the same parameters (i.e. the same ink and the same print head operating parameters are used for all test pattern images).

Next, the controller 17 activates the motor 16 so that the drum 12 is turned about the axis 14 until such time as the test pattern images are directly adjacent the curing device 22. The motor 16 is then deactivated and the controller 17 activates the curing device 22.

The controller 17 selectively activates the drives 26, 42 such that the intensity of radiation received by the ink on the substrate 18 varies among the test pattern images. For example, the controller 17 may simultaneously activate the drives 26, 42 in such a manner that the lamp 23 is moved steadily away from the substrate 18 as the lamp 23 travels across the length of the drum 12. In this example, the lamp 23 may be located in a position closely spaced to the test pattern image at the beginning of its path of travel near one side of the substrate 18 and be spaced a substantial distance from the test pattern images by the time that the carriage 24 and the lamp 23 have moved to the opposite side of the substrate 18. As a result, the intensity of UV radiation reaching the test pattern images steadily decreases from one side of the substrate 18 to the other.

Next, the controller 17 activates the motor 16 to again turn the drum 12. In this instance, the drum 12 is turned a distance sufficient to bring the cured series of test pattern images to a position directly adjacent the device 26. The controller 17 then deactivates the motor 16 to bring the drum 12 to rest.

Next, the controller 17 energizes the drive 32 in order to move the device 28 across the test pattern images from one side of the substrate 18 to the other. The controller 17 also activates the mechanism of the device 28 so that the stylus 34 is brought into contact with the test pattern images. The stylus 34 bears against the test pattern images with a constant pressure as it travels from one side of the substrate 18 to the other.

The detector 36, being connected to the device 28 for simultaneous movement, senses the color density of the portions of the test pattern images that have been in contact with the stylus 34. If, for example, the cured ink of a particular test pattern image is securely fixed to the substrate 18, the stylus 34 does not remove the ink of that image as it travels across the substrate 18. On the other hand, if the ink from a test pattern image is not securely fixed to the substrate 18, the pressure of the stylus 34 serves to remove some of the ink from the substrate 18.

If the ink of the test pattern images is of a color that contrasts with the underlying portions of the substrate 18, the detector 36 will transmit corresponding signals to the controller 17. The controller 17 then functions to determine which test pattern images are substantially unaffected by the stylus 34 and which test pattern images are abraded by the stylus 34. Those test pattern images that remain unaffected by the stylus 34 represent images that are securely fixed to the underlying substrate 18. As a consequence, the printing parameters used to print those test pattern images can then be recalled from memory and selected by the controller 17 for use in selecting the parameters to be used in printing the final printed product.

In the example mentioned above, the spacing between the curing device 28 and the series of test pattern images increases continuously and uniformly as the curing device 28 moves along the length of the drum 12. Consequently, once the controller 17 has received signals from the detector 36 that indicate a transition from a test pattern image that remains substantially intact and a test pattern image that has been at least partially abraded by the stylus 34, movement of the abrading device 32 and the detector 36 may be halted. If desired, the printing parameters that were used to print the intact test pattern image next to the abraded test pattern image (or optionally spaced somewhat from the abraded test pattern image) are then used to set the printing parameters for printing the final product. In this example, the printing parameter is the spacing between the lamp 23 and the substrate 18. For this example, the controller 17 then activates the drive 26 for shifting the curing device 22 as may be necessary to provide the selected spacing between the lamp 23 and the substrate 18 for printing the final product. For instance, the spacing may be the same as the spacing used to print the test pattern image that was not abraded, or may be somewhat smaller than that spacing.

Another example of use of the apparatus 10 involves varying the time interval (or "dwell" time) between the time that the ink is deposited on the substrate 18 and the time that such ink is cured. The dwell time is related in some instances to adhesion of the ink to the substrate 18 as mentioned above. However, the dwell time is also related to the quality of the final image for a given ink and given substrate 18.

In more detail, ink dots or drops deposited by the print head 20 onto the substrate 18 need to spread in a lateral direction to a certain minimum size in order to enable the final printed image to exhibit maximum color density and good solid fill. Good solid fill is attained when the ink drops cover the substrate 18 without spaces or gaps between adjacent ink drops. The characteristics of good solid fill and maximum color density are important to the visual quality of the image and can make the difference between a satisfactory product and an unsatisfactory product for any given combination of ink and substrate.

Once the ink drops directed from the print head 20 have contacted the substrate 18, the ink drops spread across the surface of the substrate 18. It is believed that this spreading motion is due to interfacial tension, or the difference between the surface energy of the substrate 18 and the surface tension of the ink. However, in the case of UV curable inks, once the ink is in contact with the substrate 18, molecular diffusion can take place, such that the monomers in the ink diffuse into the substrate 18. The rate of diffusion may range from insignificant to substantial.

As monomers in the ink diffuse into the substrate 18, the viscosity of the ink remaining on the surface of the substrate 18 is increased. The rate of increase in viscosity may be rapid, and will decrease the rate of spread of ink on the substrate. As a result, partially spread ink drops may tend to merge together by capillary forces, causing the formation of agglomerates of ink drops on the surface of the substrate 18. This agglomeration or coalescence-like characteristic tends to reduce density of the final image because further spreading of the ink drops is impaired.

As an example, inks containing isobornyl acrylate ("IBOA") exhibit significant molecular diffusion into olefin-based films such as "CONTROLTAC PLUS" brand graphic marking film, catalog no. 3540C, from 3M Company of St. Paul, Minn. On the other hand, IBOA-containing inks will not diffuse to any significant extent into films with acrylic surfaces such as high intensity ("HI") retroreflective film available from 3M Company of St. Paul, Minn. under the trade name "SCOTCHLITE HIGH INTENSITY SHEETING 3870". Consequently, when printing ink with a high IBOA content onto an olefin-based film, the ink drops will initially spread (and cause a corresponding initial increase in color density). However, the diffusion of the ink into the film will soon hinder further spreading and result in coalescence of the ink drops (which reduces color density). As a result, the dwell time in this instance should be relatively short, on the order of one or two seconds.

However, when the same ink is printed onto HI film, the ink drops will spread and level to give a good solid fill. In this instance, the dwell time should be relatively long to optimize the image quality. An example of a suitable dwell time in this instance is 10 or 20 seconds. However, if the dwell time is too long (for example, 2 or 3 minutes), the ink will spread in an excessive manner. Excessive ink spread may result in an image with reduced solid color density and poor edge definition.

For selection of optimal dwell times, steps are followed that are somewhat similar to the method described above. In particular, the substrate 18 is mounted on the drum 12. The controller 17 then activates the motor 16 to turn the drum 12 as needed. The print head 20 is then activated. In this instance, only a single test image is printed.

Next, the controller 17 activates the motor 16 so that the drum 12 is turned about the axis 14 until such time as the test pattern image is directly adjacent the curing device 22. After a pre-selected time interval, the controller 17 activates the curing device 22 to cure the test pattern image.

Next, the controller 17 activates the motor 16 to turn the drum 12 back to its previous position for printing a second test pattern image. After the second test pattern image has been printed, the controller 17 activates the motor 16 to turn the drum 12 back to its position adjacent the curing device 22.

Next, the curing device 22 is activated by the controller 17 after a pre-selected time interval. This time interval is different than the previous time interval. For example, the second time interval could be longer than the first time interval. Again, the lamp 23 is activated for sufficient amount of time to cure the test pattern image.

The steps described above are then repeated for a number of times until a desired number of test pattern images have been prepared and cured, each preferably using a different dwell time. Next, the controller 17 activates the motor 16 to turn the drum 12 a distance sufficient to bring the cured series of test pattern images to a position directly adjacent the device 26. The controller 17 then deactivates the motor 16 to bring the drum 12 to rest.

Next, the controller 17 energizes the drive 32 in order to move the device 28 across the test pattern images. The controller 17 also activates the mechanism of the device 28 so that the stylus 34 is brought into contact with the test pattern images. The stylus 34 bears against the test pattern images with constant pressure. As the carriage 30 moves, the device 36 senses the color density of those portions of the test pattern images that have been in contact with the stylus 34.

Subsequently, the controller 17 functions as mentioned above to determine which test pattern images are substantially unaffected by the stylus 34 and which test pattern images have been abraded by the stylus 34. The controller 17 also utilizes signals received from the detector 36 to determine which test pattern images exhibit relatively high color density. The controller 17 then selects a preferred dwell time to use for printing the final printed image, based upon the data relating to adhesion of the test pattern images as well as the data relating to color density of the test pattern images.

Optionally, the controller 17 does not activate the drive 42 during the procedure mentioned above. As a result, the intensity of radiation received by the test pattern images is the same in each instance. As another option, however, the intensity may be varied as mentioned above to further optimize selection of the final printing parameters.

Other alternatives for varying the dwell times are possible. Applicant's co-pending U.S. patent application entitled "METHOD AND APPARATUS FOR INKJET PRINTING USING UV RADIATION CURABLE INK", Ser. No. 10/000282, filed on even date herewith, describes various alternatives. The disclosure of that application is expressly incorporated herein.

The apparatus 10 as described above relates to a drum printer. However, the concepts of the present invention are also useful for use with other types of printers. Example of other suitable printers include flat bed printers and roll-to-roll printers.

Moreover, the ink used in the printer may be water-based or solvent-based, instead of the radiation curable ink described in detail above. Optionally, the curing device may also change in accordance with the printer and type of ink selected. For example, the printer may have a heater for drying water or solvent-based inks. The heater may be mounted internally within in a drum printer, below a bed of a flat bed printer, or behind another type of support for the substrate, and/or may be located externally of the support. In that instance, one of the preferred printing parameters that may be varied includes the rate of heat transferred from the heater to the printed image and/or the length of time that heat is transferred to the printed image.

Another printing parameter that may be changed is the speed of relative movement between the substrate and the curing device during the time that the printed image is cured. In the example mentioned above, the speed of the motor 16 connected to the drum 12 may be varied as the image moves past the curing device 22. As an alternative, the substrate may be held in a stationary orientation while the curing device is moved by a motor past the printed image.

Another printing parameter that may be changed is the composition of the ink. For example, the apparatus 10 could include a dispenser that adds additional curing agents in instances where a better cure is desired.

The stylus 34 could be replaced with a section of abrasive material. As an example, the abrasive material could comprise a section of coated abrasive material or "sandpaper". Preferably, means is provided to periodically replace or clean the abrasive material (for instance, with a blast of pressurized air).

Other options are also possible. For example, the device 28 could be replaced with another type of device that physically or chemically alters the test pattern images or otherwise invasively alters the images. For example, the device may include a dispenser that applies a composition to the images, so that any chemical reaction or the rate of a chemical reaction between the composition and the image can be detected. The reaction may reveal, for instance, characteristics (such as the durability) of the final printed image in an environment where components of the composition may be present, such as an urban environment with significant air pollution. Other types of devices for altering the test pattern images include devices that apply heat and/or devices that apply radiation that mimics radiation from the sun.

As another option, the device could apply a quantity of water (in the case of images containing water-based inks) or solvent (in the case of images containing solvent-based inks). In those instances, the device could include a probe that bears against the image or images in areas where water or solvent has been applied. The probe may have a fibrous tip or a tip made of fabric, sponge or other woven or non-woven material. The detector 36 functions to determine whether any portion of the image or images has been removed by the probe.

A number of other variations are also possible. Accordingly, the invention should not be deemed limited to the specific examples and embodiments that are set out above, but instead only by a fair scope of the claims that follow along with their equivalents.

What is claimed is:

1. Inkjet printing apparatus comprising:

a support for receiving a substrate;

an inkjet print head for directing ink to a substrate received on the support in order to provide an image;

a controller connected to the print head for activating the print head to print at least two test pattern images on the substrate, the controller causing at least two test pattern images to be printed using different printing parameters;

a device for altering at least one of the test pattern images on the substrate; and a detector for detecting one or more characteristics of the test pattern images, wherein the detector is connected to the controller, wherein the controller is selectively operable to vary at least one of the printing parameters in response to one or more characteristics detected by the detector in order to achieve a desired final product.

2. Inkjet printing apparatus according to claim 1 wherein the device bears against the test pattern images in order to test abrasion resistance.

3. Inkjet printing apparatus according to claim 2 wherein the device includes at least one stylus for contact with the test pattern images.

4. Inkjet printing apparatus according to claim 3 wherein the device includes a mechanism for moving the stylus across the images.

5. Inkjet printing apparatus according to claim 4 wherein the mechanism includes a motor that is connected to the controller.

6. Inkjet printing apparatus according to claim 2 wherein the device includes a section of abrasive material for contact with the test pattern images.

7. Inkjet printing apparatus according to claim 6 wherein the device includes a mechanism for moving the section of abrasive material across the test pattern images.

8. Inkjet printing apparatus according to claim 7 wherein the mechanism includes a motor that is connected to the controller.

9. Inkjet printing apparatus according to claim 2 wherein the detector is operable to determine if the test pattern image has been abraded.

10. Inkjet printing apparatus according to claim 9 wherein the detector is a spectrophotometer.

11. Inkjet printing apparatus according to claim 1 wherein the detector is operable to detect the specular reflection of the test pattern image.

12. Inkjet printing apparatus according to claim 1 and including a UV radiation curing device.

13. Inkjet printing apparatus according to claim 1 wherein the controller is operable to vary one or more printing parameters of the printing apparatus in correlation with abrasion resistance of the test pattern images.

14. Inkjet printing apparatus comprising:

a support for receiving a substrate;

a print head for directing ink to a substrate received on the support in order to provide an image;

a device for contacting at least a portion of the image on the substrate; and a detector for detecting one or more characteristics of the contacted image.

15. Inkjet printing apparatus according to claim 14 and including a UV radiation curing device.

16. Inkjet printing apparatus according to claim 14 wherein the device abrades at least a portion of the image using a certain pressure against the image, and wherein the detector determines if a portion of the image has been at least partially removed.

17. Inkjet printing apparatus according to claim 16 wherein the device includes a mechanism for movement across the test pattern images while the device is in contact with the test pattern images.

18. Inkjet printing apparatus according to claim 14 wherein the device includes at least one stylus for contact with the test pattern images.

19. Inkjet printing apparatus according to claim 18 wherein the device includes a mechanism for moving the stylus across the images.

20. Inkjet printing apparatus according to claim 14 wherein the device includes a section of abrasive material for contact with the test pattern images.

21. Inkjet printing apparatus according to claim 20 wherein the device includes a mechanism for moving the section of abrasive material across the test pattern images.

22. Inkjet printing apparatus according to claim 14 wherein the detector is a spectrophotometer.

23. Inkjet printing apparatus according to claim 22 wherein the apparatus includes a carriage, wherein the spectrophotometer is mounted on the carriage, and wherein the carriage is movable along a path such that the spectrophotometer is moved adjacent the test pattern images.

24. Inkjet printing apparatus according to claim 14 and including a controller connected to the detector, the controller being operable to vary one or more printing parameters of the printing apparatus in response to a signal received from the detector.

25. Inkjet printing apparatus according to claim 24 wherein one of the printing parameters includes the location of a curing device relative to the substrate.

26. Inkjet printing apparatus according to claim 24 wherein the printing apparatus includes a curing device, and wherein one of the printing parameters is the velocity of the substrate as it moves relative to the curing device.

27. Inkjet printing apparatus according to claim 24 wherein the printing apparatus includes a heater for heating the substrate, and wherein one of the printing parameters is the temperature of the heater.

28. Inkjet printing apparatus according to claim 24 wherein the printing apparatus includes a heat source for drying printed images, and wherein one of the printing parameters is the intensity of the heat source.

29. Inkjet printing method comprising:

selecting an ink, a substrate and a printer for printing the ink on the substrate;

inkjet printing the ink in a plurality of test pattern images on the substrate with the printer, at least one of the test pattern images being printed using one or more different printing parameters than the printing parameters used to print another test pattern image;

altering at least one of the test pattern images;

detecting one or more characteristics of at least one altered test pattern image;

correlating the detected characteristics of at least one altered test pattern image with one or more printing parameters;

selecting one or more certain printing parameters for the selected ink and the selected substrate based on the correlation; and printing a final product with the printer using the selected printing parameters.

30. Inkjet printing method according to claim 29 wherein the act of determining one or more characteristics of at least one altered test pattern image includes the act of determining whether or not a portion of at least one altered test pattern images has been removed.

31. Inkjet printing method according to claim 30 wherein the act of altering at least one of the test pattern images includes the act of moving a device across at least one of the test pattern images while in contact with the test pattern images.

32. Inkjet printing method according to claim 31 wherein the act of moving the device includes the act of moving a stylus.

33. Inkjet printing method according to claim 31 wherein the act of moving the device includes the act of moving a section of abrasive material against the test pattern images.

34. Inkjet printing method according to claim 29 wherein the printer is a UV radiation curable printer.

35. Inkjet printing method of claim 29 wherein the ink is a water based ink.

36. Inkjet printing method of claim 29 wherein the ink is a solvent based ink.

37. Inkjet printing method of claim 29 wherein one of the printing parameters includes the location of a curing device relative to the substrate.

38. Inkjet printing method according to claim 29 wherein one of the printing parameters is the velocity of the substrate as it moves relative to a curing device for curing ink.

39. Inkjet printing method according to claim 29 wherein one of the printing parameters is the temperature of a heater for heating the substrate.

40. Inkjet printing method of claim 29 wherein one of the printing parameters is the intensity of a heat source for drying printed images.

41. Inkjet printing method according to claim 29 wherein the act of detecting one or more characteristics of at least one test pattern image includes the act of detecting the specular reflection of at least one altered test pattern image.

42. Inkjet printing method according to claim 29 wherein the act of altering at least one of the test pattern images includes the act of abrading at least one image, and wherein the act of detecting one or more characteristics of at least one altered test pattern image includes the act of scanning an image.

43. Inkjet printing method according to claim 42 wherein the act of scanning an image is carried out using a spectrophotometer.

* * * * *

UNITED STATES PATENT AND TRADEMARK OFFICE

CERTIFICATE OF CORRECTION

PATENT NO. : 6,595,615 B2
DATED : July 22, 2003
INVENTOR(S) : Ylitalo, Caroline M.

It is certified that error appears in the above-identified patent and that said Letters Patent is hereby corrected as shown below:

Column 8,
Line 2, “26” should read -- 28 --.
Lines 38-40, “curing device 28” should read -- curing device 22 --.
Line 45, “abrading device 32” should read -- abrading device 28 --.

Column 10,
Line 19, “26” should read -- 28 --.
Line 28, “device 36” should read -- detector 36 --.

Signed and Sealed this

Twenty-third Day of December, 2003

JAMES E. ROGAN
*Director of the United States Patent and Trademark Office*